United States Patent [19]

Mensink et al.

[11] Patent Number: 4,532,467

[45] Date of Patent: Jul. 30, 1985

[54] CMOS CIRCUITS WITH PARAMETER ADAPTED VOLTAGE REGULATOR

[75] Inventors: Kornelis A. Mensink, Brummen; Hendrik L. Brouwer, Dieren, both of Netherlands

[73] Assignee: Vitafin N.V., Curacao, Netherlands Antilles

[21] Appl. No.: 475,025

[22] Filed: Mar. 14, 1983

[51] Int. Cl.[3] ..... G05F 3/20

[52] U.S. Cl. ..... 323/316; 323/314; 323/267; 307/304; 307/496

[58] Field of Search ..... 323/265, 267, 272, 275, 323/277, 282, 313, 314, 315, 316, 317; 307/297, 304, 496

[56] References Cited

U.S. PATENT DOCUMENTS

| | | | |
|---|---|---|---|
| 3,796,890 | 3/1974 | Thompson et al. | 323/267 |
| 4,163,161 | 7/1979 | Walker | 307/297 |
| 4,253,055 | 2/1981 | Gatten | 323/285 |
| 4,300,061 | 11/1981 | Mihalich et al. | 323/313 |
| 4,327,320 | 4/1982 | Ogvey et al. | 323/313 |
| 4,342,926 | 8/1982 | Whatley | 323/315 |
| 4,359,680 | 11/1982 | Hellums et al. | 323/315 |
| 4,442,398 | 4/1984 | Bertails et al. | 323/313 |
| 4,464,588 | 8/1984 | Wieser | 323/313 |

FOREIGN PATENT DOCUMENTS 2031193A 4/1980 United Kingdom ..... 323/313

OTHER PUBLICATIONS

IBM Technical Disclosure Bulletin, vol. 22, No. 2, pp. 790 and 791.

*Primary Examiner*—Peter S. Wong
*Assistant Examiner*—Judson H. Jones
*Attorney, Agent, or Firm*—Woodcock, Washburn, Kurtz, Mackiewicz & Norris

[57] ABSTRACT

A self-adjusting voltage regulator circuit on a CMOS chip, for use with CMOS digital and/or analog circuit, providing a voltage which is selected in accordance with the characteristics of the chip to optimally current control operation of CMOS circuits on this chip. The voltage regulator circuit has a reference CMOS pair with a predetermined geometry, and current means are provided for driving a current through said reference pair which is adjusted to operate the pair at a desired point of current controlled operation. The voltage across the reference pair is utilized to provide the regulated voltage to other CMOS pairs, which pairs have respective geometries of predetermined relation to the reference pair geometry, whereby the regulated voltage and the relative geometry provide current controlled operation of each such CMOS pair.

27 Claims, 8 Drawing Figures

CMOS CIRCUITS WITH PARAMETER ADAPTED VOLTAGE REGULATOR

BACKGROUND OF THE INVENTION

1. Field of the Invention

This invention relates to a regulated voltage supply circuit adapted for use with a CMOS chip, and in particular a regulated voltage circuit adapted to provide a voltage which is parameter determined so as to optimally operate CMOS transistors on the chip in a stable high gain mode of operation.

2. Background

The advantages of CMOS circuitry are well known in the art. Particularly for low power applications such as implantable pacemakers, CMOS circuitry is ideally suited because it provides excellent digital logic circuitry, as well as analog circuitry, with the lowest power drain of available electronic configurations. There are many commercial applications requiring one or more CMOS chips, each chip comprising a large scale integrated circuit having spread out or dispersed thereon a great number of different circuits. Most CMOS circuits which provide logic functions, such as gates, conduct only when they are actually switching, at which time both transistors of the pair conduct. This is the primary reason why CMOS circuits require minimal power. However, at the time of switching, the voltage-current operation of each transistor depends upon the supply voltage which is impressed across the CMOS pair. Depending upon the logic function being performed, a circuit designer will want to control that current to correspond to a particular range on the transistor voltage-current characteristic curve. Accordingly, the CMOS transistors can be current controlled in an optimum fashion only by controlling the voltage which is applied to the CMOS pair. This can lead to design difficulties where different CMOS pairs should be driven at different current levels, since an arbitrary voltage will not be optimized for different MOS transistors.

In applications where a CMOS chip contains both digital and analog circuits, the problem of providing the best voltage for the CMOS pairs is increased due to the larger current flow of the analog circuits. As is known, when CMOS pairs are used for analog functions, such as in conventional amplifier stages, current is flowing continuously when the circuit is in operation, making the need of current control even more critical. The current through the CMOS pair, and thus the voltage supplied across it, must be stabilized and controlled in order to achieve high gain, controlled bandwidth and circuit stability. If the supply voltage is not adjusted properly and is too high, the transistors, and thus the amplifier may operate in a strong inversion condition, which results in a relatively high current, low gain operation. Or, if the voltage is too low, the transistors may operate with as low current and an undefined low gain.

From the above, it is seen that there is a substantial problem in designing CMOS circuitry, and providing a regulated voltage suitable for all the requirements of the various circuits on a single chip. The problem is compounded in applications where a plurality of CMOS chips are employed, since each chip will have slightly different process-variable parameters. Specifically, the threshold voltage $V_{gs}$ of each CMOS transistor is processvariable, and the designer must take into account the possibility of statistical variations from chip to chip. Accordingly, a single regulated voltage which is applied to the same CMOS circuits on different chips will likely result in different operating conditions for the different CMOS circuits.

Another well known need in the art is that of conserving space, or "real estate" on the chip. Considerable time and expense goes into the process of laying out or designing a chip, so as to efficiently achieve the highest density of functional circuits per chip. Again referring to the implantable pacemaker illustration, where physical space is at a premium, it is important to minimize the number of chips which must be packaged in the pacemaker, simply to conserve space. Also, as a general proposition for any application, the expense involved is proportional to the number of chips that are utilized and have to be manufactured. There is thus a substantial need for a design which minimizes the circuitry needed to efficiently provide power and proper voltages to all the CMOS circuits on the chip or chips being used. For example, it would be very inefficient from a design point of view to have a large number of different regulated voltages available, which would have to be provided by a plulrality of supply voltage lines. Likewise, and particularly in low power applications such as implantable pacemakers, resistors frequently cannot be incorporated into the design because of the extremely high values which are needed, which values cannot be obtained on a chip. This problem can be solved by utilizing a current source or sink in place of a desired high resistor element. However, the system must avoid the need for a large number of current paths which, if utilized, would take up a great deal of space on the chip.

SUMMARY OF THE INVENTION

It is an object of this invention to provide an improved voltage regulator adapted for supplying CMOS circuits, and in particular a voltage regulator providing an output which is adapted to a process variable parameter of a CMOS chip.

It is another object of this invention to provide a voltage regulator for driving a plurality of CMOS circuits, the output voltage of which is adapted to efficiently provide a large number and wide range of current sources or sinks.

It is another object of this invention to provide a custom voltage regulator circuit for use with a CMOS chip, the voltage regulator being adapted to optimize operating conditions of CMOS pairs on the chip.

It is another object of this invention to provide a means of controlling the current of a plurality of CMOS logic circuits in an efficient and stable manner.

It is a further object of this invention to provide a plurality of CMOS circuits, and means of stable current control of such circuits at respective different current levels.

It is another object of this invention to provide electronic apparatus comprising a power source and a plurality of CMOS circuits, said CMOS circuits in turn comprising circuits for carrying out both digital and analog functions, and improved means for efficiently controlling the operation of both the digital and analog circuits.

It is another object of this invention to provide a design of a CMOS chip which enables a greater density of circuits on the chip.

It is another object of this invention to provide electronic apparatus comprising two or more CMOS chips, and means for optimizing current control of the CMOS pairs on each respective chip as a function of at least one process variable parameter of each such chip.

It is another object of this invention to provide a method of designing a CMOS chip having a plurality of CMOS circuits thereon, the method including providing a stabilized voltage which is adapted to provide optimum overall current control of the CMOS pairs on the chip.

It is another object of this invention to provide a method for designing a CMOS chip, the method including providing a parameter-adapted voltage corresponding to a CMOS pair of a first given geometry, and designing other CMOS pairs on said chip to have geometries relative to the geometry of the first pair in accordance with desired current control of such other CMOS pairs.

It is another object of this invention to provide electronic apparatus incorporating a CMOS chip, the chip having a regulated voltage circuit which provides a voltage derived from a first conducting CMOS pair having a first W/L geometry, and a plurality of circuits each having a CMOS pair of a predetermined W/L geometry relative to the first CMOS pair.

In view of the above objects there is provided a stabilized voltage regulator for CMOS circuits, in combination with a plurality of CMOS circuits including preferably analog and digitally functioning circuits, the voltage regulator having a reference CMOS pair with a given geometry, and connected to continuously operate substantially as a CMOS pair operates when its transistors are conducting. The current through the reference pair is adjusted to a desired value for efficient operation of CMOS transistors of their given geometry, thereby providing across such pair a voltage corresponding to the desired current-controlled operating conditions. The CMOS circuits on the chip comprise CMOS pairs, each such pair having a geometry substantially the same as or in a predetermined relationship to the reference pair, thereby controlling the current therethrough when such CMOS pairs conduct. The additional circuits include both logic circuits and analog circuits, each circuit having a CMOS pair operating with a current which is at some predetermined multiple of the current through the reference CMOS pair. Simple current mirror circuits are provided on the chip by use of a single CMOS pair connected with the regulated voltage thereacross, the value of the current source or sink being related to the controlled current through the reference pair as a function of the current mirror CMOS geometry relative to that of the reference pair.

DESCRIPTION OF THE PREFERRED EMBODIMENT

Figure 1:
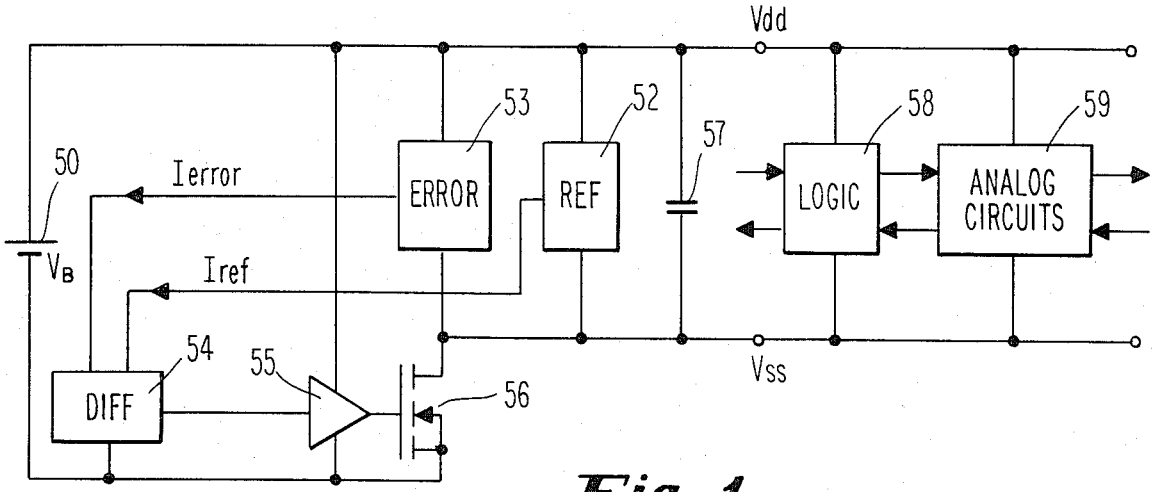
FIG. 1 is a circuit diagram showing the voltage regulator circuit of this invention on a CMOS chip and powered by a battery source, in combination with a plurality of CMOS logic and analog circuits.

Referring now to FIG. 1, there is illustrated a battery 50 which supplies a voltage $V_b$, which is electrically connected to circuits on a CMOS chip. The battery is connected to a stabilized voltage regulator circuit comprising reference current source 52, error generator 53, difference circuit 54, amplifier 55, regulator amplifier 56 and capacitor 57. The reference generator 52 is a current generator, most preferrably a CMOS circuit, which generates a stable reference current designated $I_{ref}$ which is inputted to one terminal of difference circuit 54. The error generating circuit 53, also a CMOS circuit, generates a current $I_{error}$ which is different from reference current when the voltage across circuit 53 is not adjusted and stabilized. The error current is inputted to the second terminal of difference circuit 54, the output of which represents the difference between $I_{ref}$ and $I_{error}$. This difference is amplified at amplifier 55 and applied to regulating MOS transistor 56, the output of which adjusts the voltage on the line marked $V_{ss}$, thereby adjusting the output voltage of the circuit. Capacitor 57 is a conventional output capacitor.

As shown, the output voltage $V_{dd}-V_{ss}$ is connected to logic circuits 58 and analog circuits 59, which are CMOS circuits on the same chip. As is understood in the art, these circuits are distributed across the surface of the chip, and for this invention there is no limitation on the functions performed by these circuits. However, it is emphasized that these comprise, in a typical application, a large number of different CMOS circuits distributed space wise on the chip and may comprise, by way of example, conventional digital circuitry such as gates, inverters, etc., and analog circuits such as amplifiers. As discussed in the background of this specification, the CMOS circuits comprise a pair of complementary MOS transistors. Each CMOS pair of circuits 58, 59 is electrically connected across the regulated voltage, such that the current therethrough, when the CMOS pair is conducting, is established by the value of the regulated voltage and the geometry of the CMOS pairs.

Figure 4:
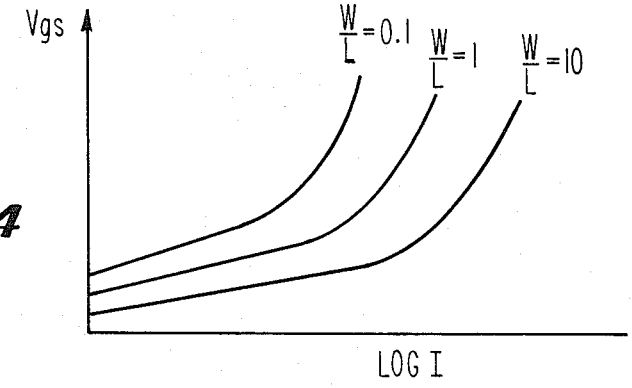
FIG. 4 is a set of curves illustrating the variation of current through an MOS transistor as a function of gate-source voltage, with the geometry variable W/L shown as a parameter.

The design basis of the regulator circuit 51 is that the process variable parameter $V_{gs}$, threshold voltage of an MOS transistor, is utilized to set and stabilize the power supply voltage for analog and digital circuits on the same chip. The threshold voltage is substantially the same for all MOS transistors on the same chip and having the same geometry. Thus, the assumption is that each MOS transistor of a given geometry, and each CMOS pair, will have the same threshold voltage value no matter where it is physically placed on the chip. However, the threshold voltage-drain current characteristic is necessarily a function of the W/L ratio, is illustrated in FIG. 4. The W/L ratio, or the ratio of channel width to channel length, is a process variable, i.e., it can be determined at the time of chip design. As illustrated in FIG. 4, transistors having a higher W/L ratio conduct a greater drain current for a given threshold voltge, while transistors with lower W/L ratios conduct correspondingly lower drain current. The lower portion of each curve is seen to be substantially linear, [i.e.: $Vgs = C_1 * \log(I * C_2)$], and in this region it is that there is a relatively large variation of current for a resulting small variation in threshold voltage. This portion of the curve, where high gain is achieved, is referred to as the weak inversion portion. Above the knee of each curve, in the "strong inversion" area, variations of voltage result in relatively small variations of output current, meaning that the gain is much smaller. It is thus seen that for stable, high gain operation, it is required that the MOS transistor be operated in the weak inversion, high gain portion of its threshold-current curve. Also, particularly for applications where total power consumption is critical, it is desirable to operate each MOS transistor in the relatively low current portion of the curve.

For any given CMOS chip, the exact placement of the curves as illlustrated in FIG. 4 is a process variable, i.e., the curves may be displaced one way or the other relative to the same curves for another chip. Thus, it is seen that for applications where CMOS pairs of different current carrying capacity are required, a given regulated voltage supply that places each transistor of a chip substantially within its linear range of operation may not be equally suitable for one or more of the other CMOS chips being powered by the same supply. Further, even in the case of a single CMOS chip, a regulated voltage source with an output voltage value which is determined simply by reference to a typical set of curves may or may not be optimized with respect to all of the different CMOS pairs on the chip. Thus, voltage which may be suitable, by way of example, for the transistors with a W/L ratio of one, may cause the transistors with higher W/L ratios to operate in the strong inversion ranges, or may operate the transistsors with lower W/L ratios at a point of virtually no current conductance and undefined gain.

The voltage regulator circuit and chip apparatus of this invention is based upon the observation that for any chip an optimum regulated voltage can be provided for placement across the CMOS pairs (each such pair having an N type and P type MOS transistor), so that each MOS transistor operates in the desired weak inversion range. This is accomplished by constructing a CMOS reference pair on the chip with a specified W/L geometry, and driving a predetermined current through such reference pair. Each other CMOS pair on the chip is constructed to have a geometry with a predetermined relation to that of the reference pair. The driving current is selected to correspond to a threshold voltage which, when applied to the other CMOS pairs, causes all of them to operate in a low current, linear range of operation. At this point, the voltage across the reference pair is precisely that voltage which is utilized to power the other CMOS pairs on the chip. This design utilizes the knowledge that when a CMOS pair is being utilized for a logic function, the pair is normally nonconducting, but when switched on both transistors are effectively saturated and in a conducting state. Likewise, a CMOS pair used for a linear function is biased so that both transistors are in an on, or conducting state. Thus, by connecting the CMOS reference pair so that both MOS transistors are conducting equally, the pair is forced to operate under the same current conducting conditions of the other similar CMOS pairs on the chip when such pairs conduct. Thus, the voltage across the reference pair assumes precisely the value that should be placed across a CMOS pair of similar geometry which is to be controlled to conduct the same amount of current. In reference to FIG. 4, if the reference pair has a geometry of W/L=1, and is current controlled to operate at a value $I_{ref}$, the output across each transistor is a specific value of $V_{gs}$. This value of $V_{gs}$, if applied to other MOS transistors of like geometry on the same chip, will control operation of such transistors at the corresponding desired current level. By choosing $I_{ref}$ properly, the voltage across the reference pair will be suitable to control all CMOS transistors on the same chip which have geometries within a given range, e.g., W/L between 0.1 and 10, to operate within their respective linear ranges. It is to be understood that the reference pair may have a W/L ratio of other than 1, the above ratio values being illustrative only.

Figure 3:
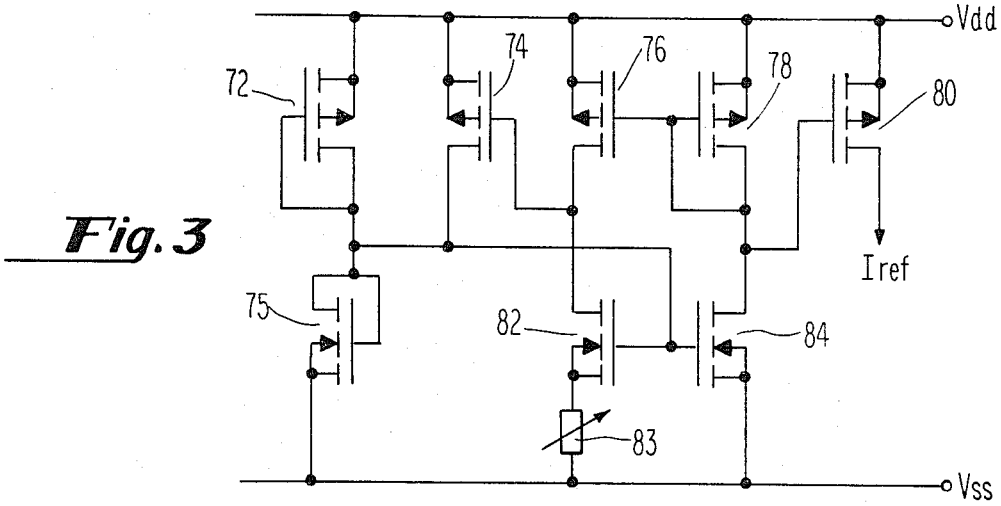
FIG. 3 is a circuit diagram of a suitable current generator circuit for use with the apparatus of this invention.
Figure 2:
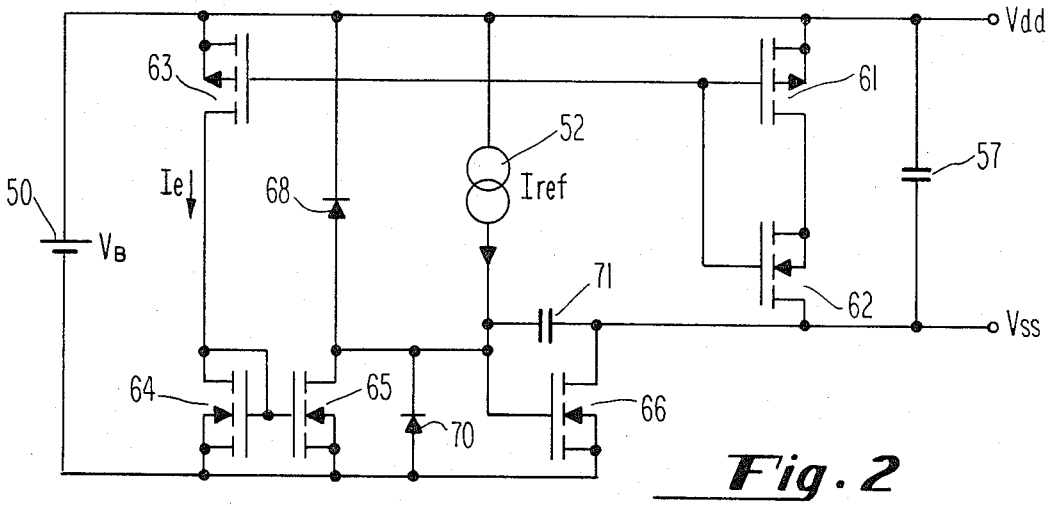
FIG. 2 is a detailed circuit diagram of the voltage regulator circuit of this invention.

Referring now to FIG. 2, there is shown a self-adjusting regulator circuit, powered by a battery 50, for supplying CMOS circuits on the same chip. The CMOS reference pair 61, 62 is connected across output terminals designated $V_{dd}$ and $V_{ss}$, and has its gates and drains connected in common. Thus, CMOS pair 61, 62 is always conducting, and simulates either a digital CMOS pair at the time that it is switching, or a constant balanced CMOS pair used in an analog circuit. The current through pair 61, 62 is the error current $I_e$ as seen in FIG. 1. The common gate of CMOS pair 61, 62 is connected to the gate of MOS transistor 63 in a current mirror configuration, such that the current through transistor 63 is also $I_e$. Thus, transistors 61, 62 and 63 constitute an error current generator, providing a current $I_e$ which is determined by the characteristics of CMOS pair 61, 62 and the voltage across that pair. Reference current generator 52 is illustrated as providing a current $I_{ref}$, which is adjusted to drive the reference pair 61, 62 at a desired level of current controlled operation. The manner of adjusting $I_{ref}$ is explained below in connection with an exemplary reference current circuit as illustrated in FIG. 3. Reference current $I_{ref}$ is differenced with the error current $I_e$ by connecting its output to the current mirror comprising MOS transistors 64 and 65. The current mirror configuration of 64, 65 causes $I_e$ to flow through transistor 65, the drain of which is connected to the output of reference current generator 52. The difference between $I_{ref}$ and $I_e$ controls the gate voltage of regulator transistor 66, the gate of which is connected to both the drain of transistor 65 and the output of reference generator 52. Thus, if the error current through reference pair 61, 62 differs from the reference current, this difference causes a swing in the voltage on the gate of regulating transistor 66. By this feedback means the output of transistor 66, connected to terminal $V_{ss}$, varies until the circuit stabilizes and the difference goes to zero. Thus, at the time that the circuit forces a current of the value of $I_{ref}$ through CMOS pair 61, 62, the output across terminals $V_{dd}$–$V_{ss}$ assumes precisely that voltage required for stable control of $I_{ref}$ through the CMOS pair. Diode 68 is utilized to provide a turn-on current, since the reference current generator is placed across the regulated voltage output. Capacitor 71 is a very small capacitor, suitably a few pico farads, providing an integrating function by dampening out voltage over-shoots due to abrupt voltage changes. Capacitor 57 is a conventional buffer capacitor at the regulator output.

From the above description, it is seen that the circuit of FIG. 2 provides a regulated stabilized output voltage which corresponds to the voltage across a CMOS pair of a given geometry, when that CMOS pair is conducting. By taking that voltage and applying it across other CMOS pairs on the chip, the current through such pairs varies from $I_{ref}$ only as a function of the transistor geometry. Thus, by defining the transistor geometry, e.g. W/L ratio of the other MOS transistors to correspond to that of the reference pair 61, 62, the current through each of the CMOS pairs can be accurately controlled, thereby controlling operation of the CMOS circuits.

Referring now to FIG. 3, there is shown a circuit diagram of a reference current generator which is used in the preferred embodiment of this invention. Transistor 72 has a W/L ratio of 0.1, and transistor 74 has a W/L ratio of 0.9. Transistor 82 has a W/L ratio of 10. The remaining transistors have ratios of 1.0, on a relative basis and being illustrative only as preferred values. The drains of transistors 72 and 74 are connected in common to the drain of transistor 75, into the gates of transistors 84, 82, 72 and 75. Transistor 72 provides start up current, biasing the gate of transistor 84 to turn it on. After start up, when there is a voltage across the current reference circuit, transistor 74 is a feedback-means to stabilize the current through 82 and 84, due to its gate being tied to the drain of transistor 76. Transistors 78 and 80 are connected in a current mirror configuration, the current through transistor 80 being the same as the current through 78, which same current passes through regulator transistor 84. Transistor 76 is also in a current mirror configuration with transistor 78, such that it passes the same current as through the output transistor 80. The current through 76 is connected through transistor 82, which has a variable resistor 83 connected between its source and the $V_{ss}$ line and which has a lower Vgs at the current-level in the operating point than transistor 84, due to the higher W/L-ratio (as can be seen in FIG. 4). The voltage developed across resistor 83 provides feedback which controls the voltage on the gate of regulator transistor 84, and stabilizes the currents. By adjusting value of resistor 83, the voltage thereacross is adjusted, and $I_{ref}$ can be controlled to the required value. It is to be noted that resistor 83 can physically be replaced by small integrated capacitors, one or more of which are switched in parallel with a switching circuit controlled by a clock signal from an available clock oscillator. If this alternate configuration is used, no external adjustment is required, but rather the switchable capacitance and the clock frequency are correctly controlled to provide the desired stabilizing feedback. There is thus illustrated an exemplary circuit for providing a controllable reference current, which in turn is utilized in the regulator circuit 51 to provide the desired regulated voltage.

In practice, the value of $I_{ref}$ is adjusted for each chip, to optimize the regulated voltage for the range of W/L ratios used on the chip. By way of illustration, the W/L ratio of the reference pair may be made substantially in the middle of the range of ratios used on the chip. The value of $I_{ref}$ is then adjusted to place the operation of the reference pair at approximately the center of the linear part of the $V_{gs}$-$I_D$ curve. In this manner, the resulting regulated voltage operates all the CMOS pairs within the linear range of each. As used in this specification, when speaking of the geometry of the CMOS pair, it is understood that each MOS transistor has the same geometry. Also, by the phrase "relation" of one pair geometry to another is meant the difference in geometry of such pairs, e.g., the relative difference of W/L ratios or other parameter which affects operation conditions.

Figure 5:
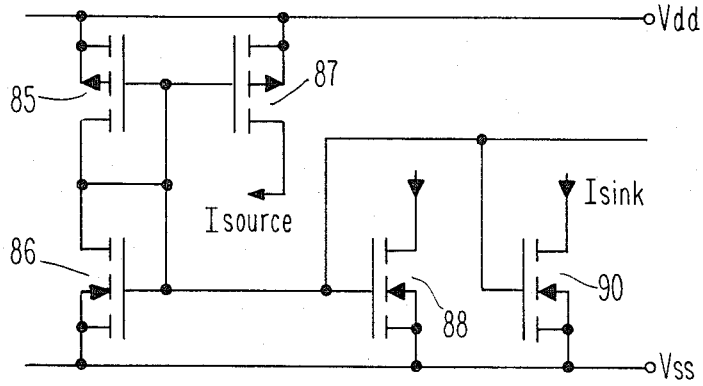
FIG. 5 is a CMOS circuit diagram for providing a simple current source of current sink, as utilized in the practice of this invention.

Referring now to FIG. 5, there is shown a simple circuit providing a current source and two current sinks, to illustrate one of the advantages of the apparatus and method of this invention. By using a single CMOS pair 85, 86, and a current mirror configuration with an MOS transistor 87, a current source is achieved, which provides a current which is a function only of the geometry of the source CMOS pair relative to that of the reference pair. Thus, if the W/L ratio of CMOS pair 85, 86 is the same as that of the reference pair 61, 62, the current provided at the output of transistor 87 is precisely $I_{ref}$. Since the same voltage is applied across CMOS pair 85, 86 as across the reference pair, and the threshold voltage is controlled to be the same, the resulting current must be the same. By changing the W/L ratio of pair 85, 86 relative to that of the reference pair, different controlled current sources can easily be achieved. In the same circuit, a pair of current sinks are shown, achieved by connecting MOS transistors 88 and 90 in a current mirror configuration with transistor 86. The same remarks apply to the current sink circuits, namely the sink current can be adjusted by fixing the geometry of each sink transistor relative to that of the geometry of the reference pair. By this means, and using a single CMOS pair at the place where the source or sink is desired, considerable chip space can be saved by providing local current generation. The sources and sink circuits can apply high impedance loads used for pulling up or down for logical inputs, simple D/A converters in combination with switches, etc. As mentioned previously, in low power applications, a current source can be utilized in place of a high value resistor, and can be scaled easily and conveniently to the right amplitude by adjusting the transistor geometry.

Figure 6:
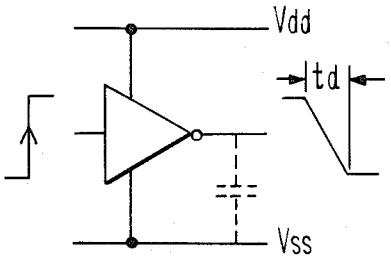
FIG. 6 is a diagram illustrating driving a CMOS logic circuit with the apparatus of this invention.

FIG. 6 is illustrative of the value of this invention in current control of CMOS logic circuits. Since all CMOS inverters, as well as more complex circuits such as counters which use such basic circuits, are current controlled during the transition from one logic state to the other, transition time is made primarily dependent upon the capacitive load and the logic voltage swing. Since the logic voltage swing is equal to the regulated supply voltage, the delay time td of a logic circuit can be controlled by scaling the W/L geometry of each transistor in the CMOS pair to get the desired delay time corresponding to the capacitive load.

Figure 7:
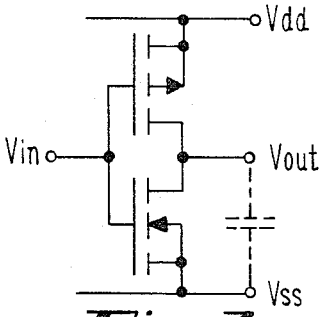
FIG. 7 is a circuit diagram illustrating a CMOS analog circuit as utilized in this invention.

FIG. 7 is representative of a simple linear amplifier utilizing a CMOS pair. Since current flows continuously when operating in the linear state, current control is particularly important. For this simple amplifier circuit, the DC gain is approximately equal to $V_{in} \times gm \times Z_{load}$. Since $g_m$, the transconductance, is proportional to the current density when the transistor is operated in the weak inversion area, the current control of this invention provides stabilized control of the amplifier gain. Such a single stage amplifier can thus be controlled to have a stable high gain and bandwidth. Note that if the regulated supply voltage as provided by this invention is not provided, the amplifier possibly works in a strong inversion area with a smaller gain and a higher current, or could well operate with too low a current and an undefined small gain. Of course, the amplifier stage illustrated in FIG. 7 operates symetrically, so that the positive going output signal and the negative going output signal have the same speed and impedence.

Figure 8:
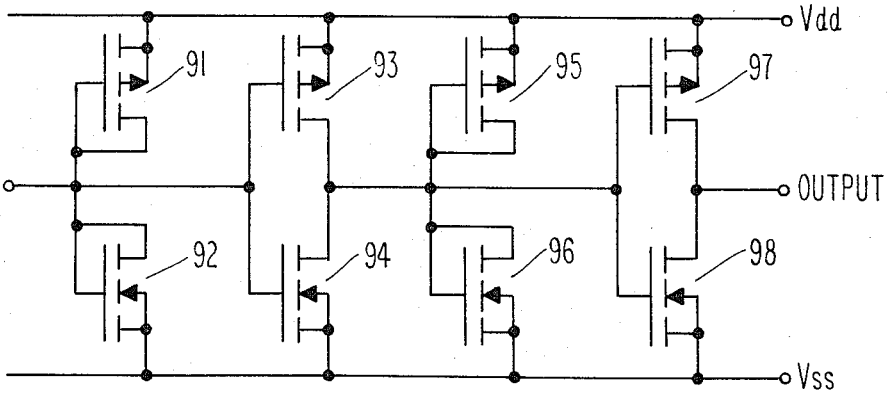
FIG. 8 is a circuit diagram of an input/output biasing circuit as utilized in this invention.

FIG. 8 is an illustration of an input/output biasing circuit. CMOS pair 91, 92 is connected as the input bias to the first amplifier 93, 94. CMOS pair 95, 96 provides the output bias for the second amplifier pairs 97, 98. This circuit provides a ratio controlled gain which is equal to the W/L ratio of the amplifier CMOS pairs divided by the W/L ratio of the output bias pair 95, 96. Since the transconductance in weak inversion operation is proportional to current, the input bias impedance is set by the geometry of the input bias CMOS pair. The inputs and outputs are stabilized at the switch point of the second amplifier, providing for fast response. If desired, the output bias can be scaled to be asymmetrical, providing a ratio-programmable comparator offset where the second amplifier output is forced either high or low when the input is close to the switching point.

It is to be noted that the digital and analog circuits illustrated as part of this invention are exemplary, and the illustration of these circuits does not place any limitation upon the scope of the invention. It is seen that by providing a regulated voltage which is a function of a controlled current through a CMOS reference pair of a specific geometry, and by designing the geometry of the MOS transistors used in other CMOS circuits on the chip, there is provided both improved stability and reliability of operation, and flexibility of design. In practice, the W/L ratio of the reference pair is chosen by utilizing the smallest W and smallest L available in fabrication of the CMOS chip. This means that each basic MOS transistor is physically as small as possible. For constructing MOS transistors with larger or smaller W/L ratios, the designer need only increase either W or L. Thus, the method of this invention involves fabricating a regulated voltage supply utilizing a CMOS pair with a controlled geometry, and designing other CMOS circuits on the chip, to be powered by the regulated voltage, the other CMOS circuits having geometries selected relative to the reference pair so as to provide for the desired controlled current operation. The system and method of this invention thus provided for optimum design of a CMOS chip, resulting in increased utilization of the space on the chip, stable and controlled low current operation, and increased flexibility of design.

We claim:

1. A self adjusting voltage regulator circuit for use with CMOS circuits, comprising a reference complimentary MOS transistor pair with a predetermined geometry, and connecting means for connecting the transistors of said pair so that they are both conducting, current means for driving a reference current through said reference pair to operate the MOS transistors of said pair within a predetermined operating range, and output means for delivering an output voltage developed across said CMOS pair.

2. The circuit as described in claim 1, wherein the gates and drains of said MOS transistors of said CMOS pair are electrically connected together.

3. The circuit as described in claim 1, wherein said current means comprises a reference current source circuit for providing a predetermined reference current selected to operate each said MOS transistor with said reference current.

4. The circuit as described in claim 1, comprising error sense means for determining the current through said reference pair and comparing said reference pair current with said reference current, and regulating means for regulating the voltage across said reference pair as a function of said comparison, whereby the voltage across said reference pair is rendered stable when the current therethrough is substantially equal to said reference current.

5. The circuit as described in claim 1 or 4, in combination with a plurality of additional CMOS circuits electrically connected across said output, each of said additional circuits comprising a CMOS pair having a geometry which is in a predetermined relation to the geometry of said reference pair.

6. The circuit as described in claim 1, in combination with a plurality of CMOS current source circuits electrically connected across said output, each of said current source circuits comprising a CMOS pair of predetermined geometry in relation to the geometry of said reference pair, whereby each said current source provides a current having a predetermined relation to said reference current.

7. The circuit as described in claim 1, in combination with a plurality of CMOS current sink circuits electrically connected across said output, each of said current sink circuits comprising a CMOS pair of predetermined geometry in relation to the geometry of said reference pair, whereby each said current sink provides a current having a predetermined relation to said reference current.

8. The circuit as described in claim 1, in combination with a plurality of additional CMOS circuits electrically connected across said output, each of said additional circuits comprising a CMOS pair, each MOS transistor of said pair having a W/L geometry of a predetermined relationship to that of said CMOS reference pair.

9. The combination of claim 8, wherein said output voltage is of a value to operate each said MOS transistor in a weak inversion mode.

10. A chip having a large plurality of CMOS circuits, a battery source for providing power, a voltage regulator circuit connected to receive the power from said battery, said regulator circuit having means for providing an output voltage corresponding to the voltage across a reference CMOS pair when said pair is conducting with about a predetermined reference current, at least some of said CMOS circuits being connected across said output voltage and having CMOS pairs with geometry selected to operate at about said predetermined current or a selected ratio of said predetermined current.

11. The apparatus as described in claim 10, wherein a first group of said connected CMOS circuits are current source circuits, each of said current source circuits providing a current which is a predetermined ratio of said reference current.

12. The apparatus as described in claim 10, wherein said voltage regulator circuit comprises a CMOS pair which has a predetermined W/L geometry, and wherein each of said plurality of circuits has a CMOS pair with a W/L geometry which is in a predetermined relation to said predetermined W/L geometry.

13. The apparatus as described in claim 11, wherein the CMOS pair of said regulator circuit operates in a weak inversion range and has the smallest W/L geometry of any of the CMOS pairs on said chip, and wherein the W/L of each CMOS pair of said connected circuits is a predetermined ratio of said reference pair, whereby each CMOS pair is operated in weak inversion range of operation.

14. The apparatus as described in claim 10, wherein said connected circuits are located substantially throughout the area of said chip, and a plurality of said connected circuits are current source circuits comprising a CMOS pair connected across the output of said voltage regulator circuit and of predetermined geometry relative to said reference pair, thereby providing current sources of predetermined current values at various positions on said chip.

15. The apparatus as described in claim 10, wherein some of said CMOS circuits are analog circuits and respective others of said circuits are digital circuits.

16. A large scale integrated circuit chip, having a plurality of CMOS circuits distributed on a surface of said chip, power supply circuit means on said chip for providing a regulated voltage and means for connecting said regulated voltage to said distributed CMOS circuits, said power supply means having a conducting CMOS pair of a given geometry and means for producing said regulated voltage to correspond to the voltage across said CMOS pair, at least one of said distributed CMOS circuits having a CMOS pair having a geometry with a predetermined relationship to said given geometry, whereby the operating condition of said CMOS circuit is controlled.

17. The integrated circuit chip as described in claim 16, wherein said power supply circuit means comprises a circuit for driving a predetermined current through said conducting CMOS pair of given geometry, said predetermined current being selected to operate such said CMOS pair in a high gain region of operation.

18. The integrated circuit chip as described in claim 17, wherein said CMOS pair of given geometry has a first W/L ratio, and each CMOS pair of said CMOS circuits has a W/L ratio having a respective predetermined relationship to said first W/L ratio.

19. The chip as described in claim 16, wherein at least some of said distributed CMOS circuits are current source circuits, wherein the value of the current provided by each said source circuit is determined by the relation of the geometry of the CMOS pair of said circuit to said given geometry.

20. A CMOS chip, having a plurality of CMOS circuits distributed on a surface of said chip, and a regulated voltage circuit on said chip for providing a regulated voltage and means for connecting said regulated voltage across CMOS pairs in said CMOS circuits, characterized by said regulated voltage circuit comprising a reference CMOS pair and circuit means for causing said CMOS pair to conduct at about a selected current level and means for providing the voltage across said reference pair as the voltage output of said regulated voltage circuit, said reference pair having a first selected geometry, said CMOS circuits each comprising at least a CMOS pair having a geometry of a predetermined relationship to said selected geometry, whereby each said CMOS pair is controlled to conduct with a current having a predetermined current relationship to said reference current when it conducts.

21. A method of providing a regulated voltage for a large scale integrated circuit chip, said chip having a plurality of CMOS circuits distributed on its surface, comprising:

a. constructing a reference CMOS pair on said chip and providing such reference pair with a selected geometry;

b. biasing said reference CMOS pair to continuously operate in a conducting condition;

c. constructing a current drive circuit on said chip adapted to receive power from an external source and to drive a stabilized current through said reference CMOS pair, whereby the voltage across said reference CMOS pair is a regulated voltage determined by said selected geometry and said stabilized current;

d. for each of said CMOS circuits, constructing a CMOS pair of a predetermined respective geometry relative to said selected geometry, and connecting said regulated voltage across each said CMOS pair, whereby when each said CMOS pair is in an on state it conducts with a current controlled as a function of said predetermined current and said relative geometry.

22. The method as described in claim 21, comprising constructing some of said CMOS circuits as digital circuits, and others of said CMOS circuits as analog circuits.

23. A large scale integrated circuit chip, said chip having a plurality of CMOS circuits distributed on its surface, each of said CMOS circuits having a CMOS pair with a common regulated voltage thereacross, a voltage regulator circuit on said CMOS chip for providing said regulated voltage, said regulator circuit having a CMOS reference pair with a first selected geometry and biased to operate in a conducting condition, current drive circuit means adapted to receive power from an external source for driving a stabilized current through said reference CMOS pair, each of said CMOS circuits having a CMOS pair of a predetermined respective geometry relative to said selected geometry, and means for connecting the voltage across said reference CMOS pair across each said CMOS pair.

24. The chip as described in claim 23, wherein at least some of said CMOS pairs of said CMOS circuits have geometries different from said selected geometry, said different geometries being within a predetermined range of relative different geometries.

25. The chip as described in claim 24, wherein said reference CMOS pair has a selected W/L ratio, and said different geometry CMOS pairs have W/L ratios within a range of about 10 times as great and 10 times as small as said selected W/L ratio.

26. The CMOS chip as described in claim 10, wherein each CMOS pair of said plurality of said CMOS circuits has a W/L ratio within a predetermined range, and said reference CMOS pair has a W/L ratio substantially in the middle of said range.

27. The method as described in claim 21, comprising fixing the W/L ratio of each CMOS pair of said CMOS circuits to be within a predetermined range, and fixing the W/L ratio of said reference pair to be substantially in the middle of said range.

* * * * *